US009977389B2

(12) United States Patent
Obara et al.

(10) Patent No.: US 9,977,389 B2
(45) Date of Patent: May 22, 2018

(54) SHEET STACKING APPARATUS AND IMAGE FORMING APPARATUS

(71) Applicant: CANON KABUSHIKI KAISHA, Tokyo (JP)

(72) Inventors: Yuichi Obara, Yamato (JP); Masaki Sato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/046,596

(22) Filed: Feb. 18, 2016

(65) Prior Publication Data

US 2016/0259287 A1 Sep. 8, 2016

(30) Foreign Application Priority Data

Mar. 5, 2015 (JP) ..... 2015-043474

(51) Int. Cl.

| | |
|---|---|
| ***B65H 1/00*** | (2006.01) |
| ***G03G 15/00*** | (2006.01) |
| ***B65H 31/20*** | (2006.01) |
| ***B65H 1/04*** | (2006.01) |

(Continued)

(52) U.S. Cl.

CPC ..... *G03G 15/6529* (2013.01); *B65H 1/04* (2013.01); *B65H 1/12* (2013.01); *B65H 1/266* (2013.01); *B65H 31/20* (2013.01); *G03G 15/6502* (2013.01); *B65H 2405/10* (2013.01); *B65H 2405/111* (2013.01); *B65H 2405/114* (2013.01);

(Continued)

(58) Field of Classification Search

CPC ..... B65H 2511/12; B65H 2701/1131; B65H 1/00; B65H 2405/00; B65H 2405/1116; B65H 2405/112; B65H 2405/113; B65H 2405/114; B65H 2511/10

See application file for complete search history.

(56) References Cited

U.S. PATENT DOCUMENTS

| | | | |
|---|---|---|---|
| 5,021,837 | A | 6/1991 | Uto et al. |
| 5,137,265 | A | 8/1992 | Sato et al. |
| 5,203,552 | A | 4/1993 | Hoshi et al. |

(Continued)

FOREIGN PATENT DOCUMENTS

| | | | |
|---|---|---|---|
| JP | 62-056223 | A | 3/1987 |
| JP | 62-56224 | * | 3/1987 |

(Continued)

OTHER PUBLICATIONS

Machine translation of JP 1-285533.*

*Primary Examiner* — Thomas A Morrison
(74) *Attorney, Agent, or Firm* — Fitzpatrick, Cella, Harper & Scinto

(57) ABSTRACT

A sheet stacking apparatus includes a body, a stacking portion which a sheet is stacked, a width regulating portion configured to move between a first position and a second position closer to a center of the stacking portion in a width direction orthogonal to a sheet feeding direction than the first position, and including a regulating surface configured to regulate a position, in the width direction, of the sheet stacked on the stacking portion, and a supporting portion pivotably supporting the stacking portion. The supporting portion is disposed on the body and closer to the center of the stacking portion in the width direction, than the regulating surface of the width regulating portion positioned at the first position.

11 Claims, 9 Drawing Sheets

(51) Int. Cl.
*B65H 1/12* (2006.01)
*B65H 1/26* (2006.01)

(52) U.S. Cl.
CPC ..... *B65H 2511/12* (2013.01); *B65H 2511/20* (2013.01); *B65H 2801/03* (2013.01)

(56) References Cited

U.S. PATENT DOCUMENTS 5,297,787 A * 3/1994 Shirai ..... B65H 1/04 271/171
5,385,340 A 1/1995 Hiroi et al.
5,390,016 A 2/1995 Hoshi et al.
5,897,250 A 4/1999 Hirai et al.
7,708,265 B2 * 5/2010 Kusama ..... G03G 15/6511 271/117
7,712,988 B2 * 5/2010 Hattori ..... B65H 1/266 271/145
8,882,377 B2 * 11/2014 Kim ..... B65H 1/266 271/171
9,027,920 B2 5/2015 Sato et al.
2009/0295070 A1 * 12/2009 Yamamoto ..... B65H 3/5215 271/147
2011/0058883 A1 * 3/2011 Kim ..... B65H 1/266 400/613
2013/0106049 A1 * 5/2013 Sato ..... G03G 15/6502 271/164
2015/0293490 A1 10/2015 Obara

FOREIGN PATENT DOCUMENTS

JP 1-285533 * 11/1989
JP 6-32489 * 2/1994
JP 6-48591 * 2/1994
JP 08-53232 A 2/1996
JP 10-029731 A 2/1998
JP 2004-323126 A 11/2004
JP 2008-110856 A 5/2008

* cited by examiner

SHEET STACKING APPARATUS AND IMAGE FORMING APPARATUS

BACKGROUND OF THE INVENTION

Field of the Invention

The present invention relates to a sheet stacking apparatus configured to have sheets stacked thereon, and an image forming apparatus including the sheet stacking apparatus.

Description of the Related Art

Hitherto, a sheet feed cassette including a sheet stacking member disposed elevatably so that stacked sheets can be pressed against a sheet feed roller and a regulating member configured to regulate an end portion of the sheets stacked on the sheet stacking member has been proposed.

Japanese Patent Application Laid-Open Publication No. 8-53232 discloses a sheet feed cassette including a width regulating member configured to regulate an end portion of a sheet in a width direction, a conveyance direction regulating member configured to regulate an end portion of the sheet in a length direction (longitudinal direction), and a sheet stacking member capable of pivoting with respect to a housing. The width regulating member and the conveyance direction regulating member are disposed movably to correspond to sheet sizes, and the sheet stacking member is configured so as not to interfere with the width regulating member and the conveyance direction regulating member.

Recently, there are increasing demands for inexpensive and small-sized printers or copying machines that can be installed in offices or at home, and so it is desirable to further reduce costs and realize downsizing of sheet feed cassettes disposed in such printers and copying machines. Along with the downsizing of the image forming apparatuses, it is required for the sheet feed cassettes to cope with a greater variety of sheet sizes. Furthermore, there are demands to enhance the performance of conventional printers and machines regarding reproducibility of images printed on the sheets (printing precision).

According to the sheet feed cassette disclosed in Japanese Patent Application Laid-Open Publication No. 8-53232, the housing must be increased in size in order to enable use of sheets having a larger size compared to the conventional sheets, and as a result, the whole apparatus had to be increased in size. On the other hand, in order to enables sheets having a smaller size compared to the conventional sheets to be used, the width regulating member and the conveyance direction regulating member must be downsized to prevent the width regulating member and the conveyance direction regulating member from interfering with the sheet stacking member.

However, when the width regulating member and the conveyance direction regulating member are downsized, the contact area between the end portion of the sheet and the width regulating member or the conveyance direction regulating member is reduced. Therefore, the accuracy of positioning the sheets is deteriorated, and especially when sending large sized sheets from the sheet feed cassette, the amount of skewing caused in the sheets is increased. The increase in the amount of skewing of the sheets leads to deteriorated printing precision.

SUMMARY OF THE INVENTION

According to a first aspect of the present invention, a sheet stacking apparatus includes a stacking portion configured to move between a first position and a second position closer to a center of the stacking portion in a width direction orthogonal to a sheet feeding direction than the first position, and comprising a regulating surface configured to regulate a position, in the width direction, of the sheet stacked on the stacking portion, and a supporting portion pivotably supporting the stacking portion, the supporting portion disposed on the body and closer to the center of the stacking portion in the width direction than the regulating surface of the width regulating portion positioned at the first position.

According to a second aspect of the present invention, a sheet stacking apparatus includes a stacking portion on which a sheet is stacked, a width regulating portion configured to move between a first position and a second position closer to a center of the stacking portion in a width direction orthogonal to a sheet feeding direction than the first position, and comprising a regulating surface configured to regulate a position, in the width direction, of the sheet stacked on the stacking portion, and a body comprising a bottom panel retaining an upstream side, in a sheet feeding direction, of a sheet stacked on the stacking portion, and a supporting portion disposed on the bottom panel and pivotably supporting the stacking portion.

Further features of the present invention will become apparent from the following description of exemplary embodiments with reference to the attached drawings.

DESCRIPTION OF THE EMBODIMENTS

Figure 1:
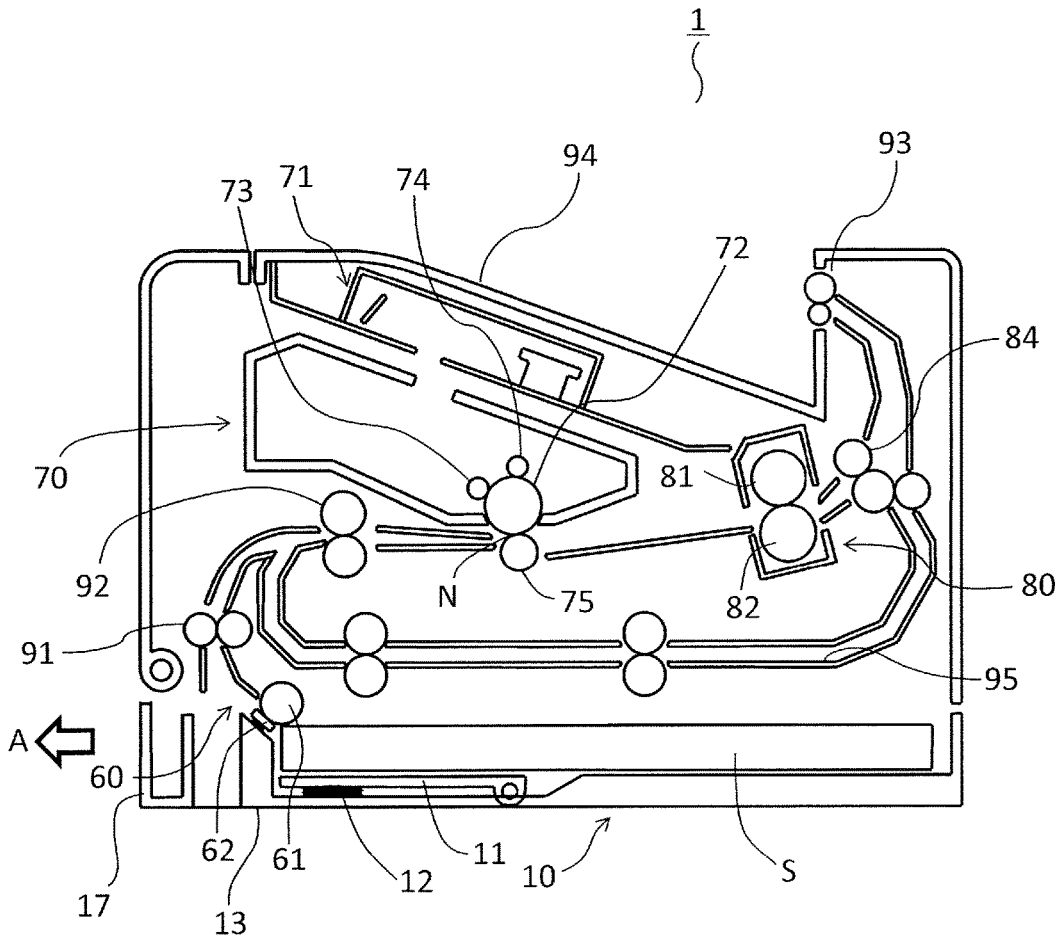
FIG. 1 is a general schematic view of a printer according to a present embodiment.

A printer 1, i.e., image forming apparatus, according to a preferred embodiment of the present invention is an electrophotographic laser beam printer. As illustrated in FIG. 1, the printer 1 includes a cassette 10, i.e., sheet stacking apparatus, configured to store sheets, a feeding unit 60 configured to feed the sheets stored in the cassette 10, an image forming unit 70 configured to form images on sheets, and a fixing unit 80.

The image forming unit 70 includes a laser scanner 71, a photosensitive drum 72, a developing roller 73, and a charging roller 74. When an image forming command is output to the printer 1, an image forming process by the image forming unit 70 is started based on an image information entered, for example, from an external computer coupled to the printer 1. The laser scanner 71 irradiates laser beams onto the photosensitive drum 72 based on the entered image information. At this time, the photosensitive drum 72 is charged in advance by the charging roller 74, and an electrostatic latent image is formed on the photosensitive drum 72 by having laser beams irradiated thereon. Thereafter, the electrostatic latent image is developed by the developing roller 73, and a toner image is formed on the photosensitive drum 72.

An intermediate plate 11 on which a sheet S is stacked is biased and pivoted upward by a coil spring 12 in parallel with the image forming operation described above. As a result, a front end portion of the sheet S stacked on the intermediate plate 11 is pressed against a feeding roller 61. The feeding roller 61 is controlled to rotate clockwise only during feeding of the sheets, and sheets S are separated and fed one by one by the feeding roller 61 and a separating pad 62 of the feeding unit 60. The sheet S having been fed is conveyed via intermediate rollers 91 to registration rollers 92.

The registration rollers 92 cause the sheet S to be looped, correct skewing of the sheet, and convey the sheet S at a predetermined conveyance timing to a transfer nip N, i.e., image forming portion, formed by the photosensitive drum 72 and a transfer roller 75. The toner image formed on the photosensitive drum 72 is transferred onto the sheet S by having a transfer bias applied from the transfer roller 75 at the transfer nip N. The sheet S has the toner image fixed thereon by a heating roller 81 and a pressure roller 82 of the fixing unit 80, and the sheet S is discharged on a discharge tray 94 by a discharge roller pair 93.

When forming images on both sides of a sheet, the sheet having an image formed on a first side is reversed by a triple roller 84 arranged downstream in a sheet feeding direction of the fixing unit 80, and thereafter, guided to a duplex conveyance path 95. The sheet is re-conveyed to the registration rollers 92, then an image is formed on a second surface of the sheet by the transfer nip N. Thereafter, the sheet is discharged on the discharge tray 94.

Figure 7A:
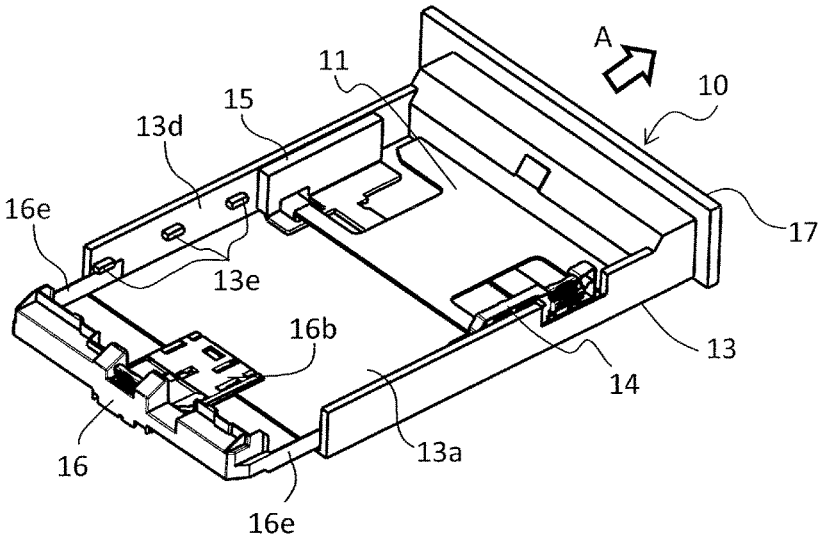
FIG. 7A is a perspective view of the rear end regulating member positioned at the first position.

As illustrated in FIG. 1 and FIG. 7A, the cassette 10 includes a case 13, i.e., body, having the intermediate plate 11, i.e., stacking portion, on which sheets are stacked and retaining the intermediate plate 11 in a pivotable manner, and a coil spring 12 biasing the intermediate plate 11 upward. The cassette 10 also includes width regulating members 14 and 15 regulating positions in a width direction orthogonal to a feeding direction of the sheets S stacked on the intermediate plate 11, and a rear end regulating member 16 regulating a rear end (upstream end in the feeding direction) of the sheets S. The cassette 10 can be drawn out in direction A illustrated in FIG. 1 using a handle, on a decorative panel 17 disposed on an end portion in the feeding direction of the case 13.

As illustrated in FIGS. 2A through 3B, one width regulating member 14, i.e., width regulating portion, includes a regulating surface 14*a* configured to regulate the width direction position of the sheet S, a connecting portion 14*b* extending toward the other width regulating member 15, and a lever portion 14*c* configured to position the width regulating member 14. The lever portion 14*c* has a lock portion 14*d* capable of being engaged with a rack portion 13*b* formed on a bottom panel 13*a* of the case 13, and the rack portion 13*b* and the lock portion 14*d* are engaged at a home position by the action of an elastic spring 18, and the width regulating member 14 is fixed to position.

The lever portion 14*c* of the width regulating member 14 is operated against the biasing force of the elastic spring 18, so that the engagement between the rack portion 13*b* and the lock portion 14*d* is released, and the width regulating member 14 is enabled to be moved in the width direction (direction of arrow B). Hooks 14*e* and 14*e* capable of engaging with holes not shown formed on the case 13 protrude downward from a bottom surface of the width regulating member 14, realizing a configuration where the width regulating member 14 will not fall from the case 13.

A through-hole 14*f* is formed on the regulating surface 14*a* of the width regulating member 14 so that the regulating surface does not interfere with the intermediate plate 11 when the width regulating member 14 is moved in the width direction, and a rack 14*g* that engages with a pinion 19 is formed on the connecting portion 14*b*. As illustrated in FIGS. 3A and 3B, the connecting portion 14*b* of the width regulating member 14 is only illustrated to a halfway section in the width direction, but actually, as illustrated in FIG. 2B, the connecting portion extends in the width direction and is engaged with the pinion 19.

Figure 2A:
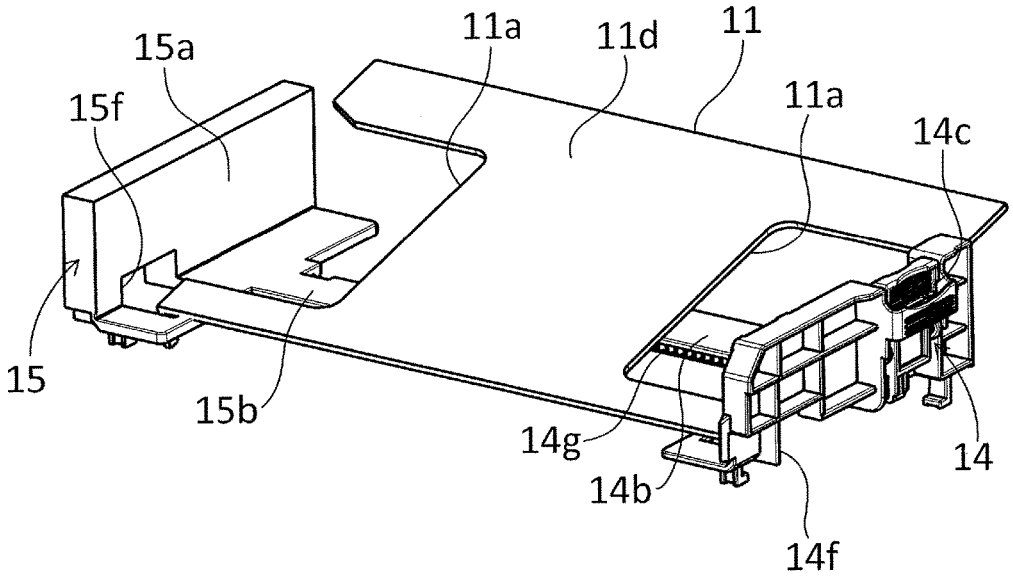
FIG. 2A is a perspective view of an intermediate plate and a width regulating member seen from above.
Figure 2B:
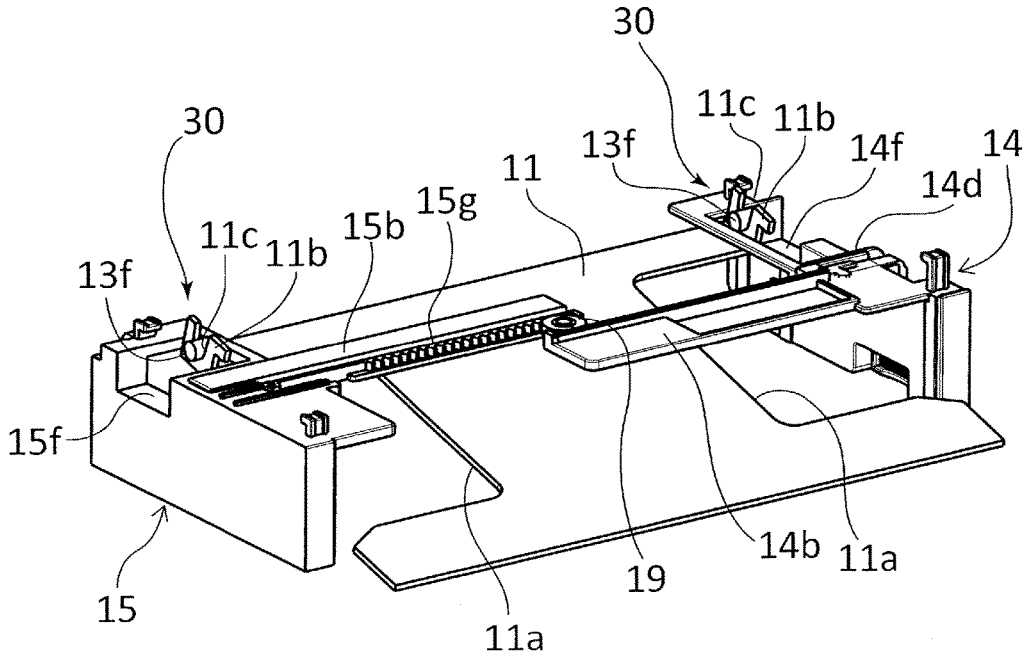
FIG. 2B is a perspective view of the intermediate plate and the width regulating member seen from below.
Figure 3A:
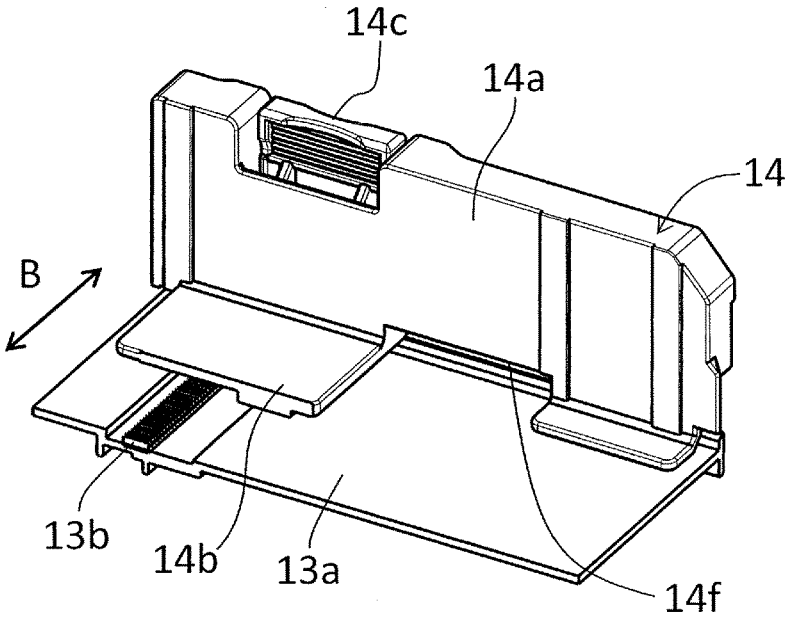
FIG. 3A is a perspective view of one width regulating member seen from above.
Figure 3B:
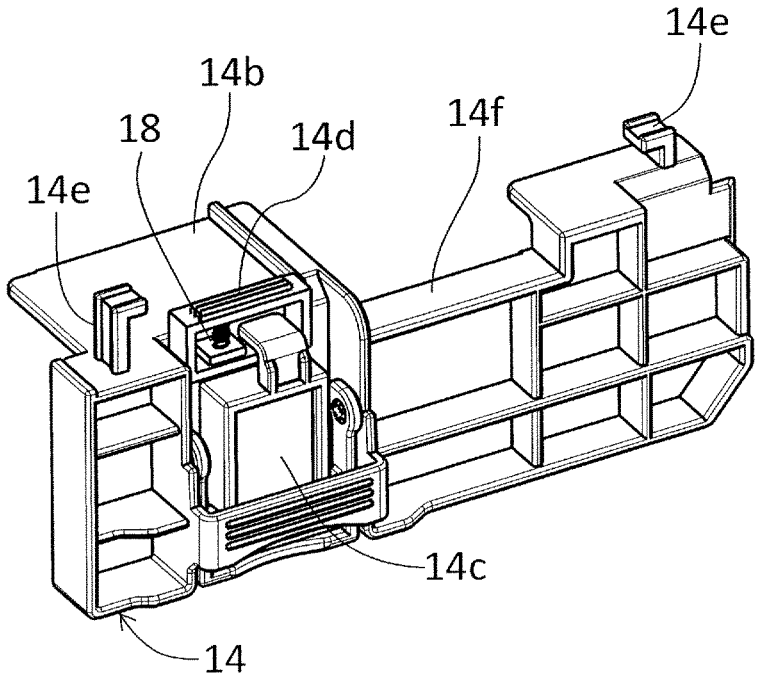
FIG. 3B is a perspective view of one width regulating member seen from below.
Figure 4:
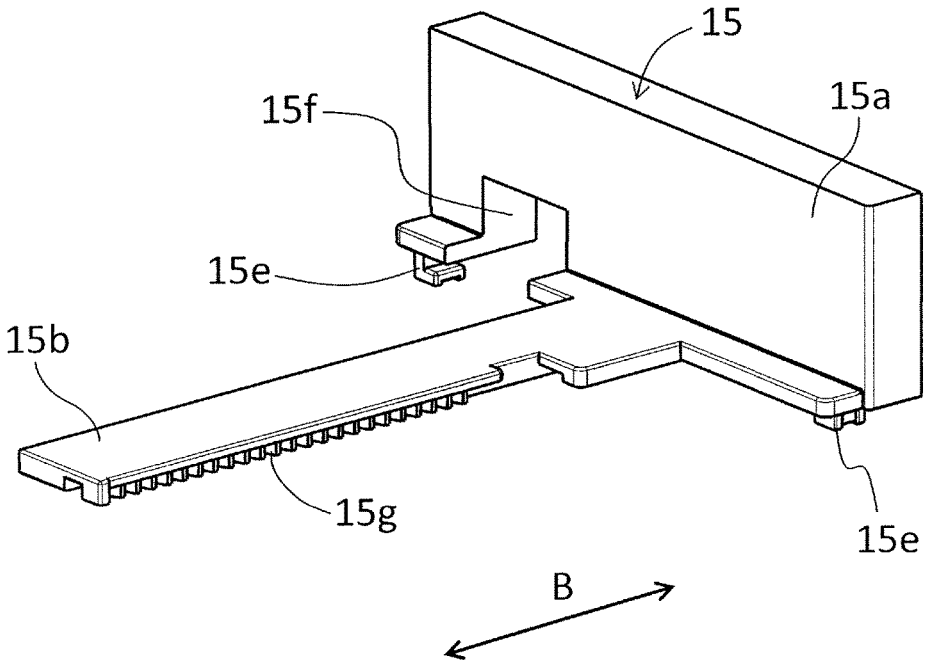
FIG. 4 is a perspective view of another width regulating member.

As illustrated in FIG. 2B and FIG. 4, the other width regulating member 15, i.e., width regulating portion, includes a regulating surface 15*a* configured to regulate the width direction position of the sheet S, and a connecting portion 15*b* extending toward the other width regulating member 14. A through-hole 15*f* is formed on the regulating surface 15*a* so that the regulating surface does not interfere with the intermediate plate 11 when the width regulating member 15 is moved in the width direction. Hooks 15*e* and 15*e* capable of engaging with holes not shown formed on the case 13 protrude downward from a bottom surface of the width regulating member 15, realizing a configuration where the width regulating member 15 will not fall from the case 13.

A rack 15*g* that engages with a pinion 19 from the side opposite to the connecting portion 14*b* is formed on the connecting portion 15*b* of the other width regulating member 15, and the other width regulating member 15 is moved in the width direction in connection with the movement in the width direction (i.e., direction of arrow B) of the width regulating member 14.

As illustrated in FIGS. 2A and 2B, the intermediate plate 11 has a stacking surface 11*d* on which sheets are stacked, and projecting surfaces 11*b* and 11*b*, i.e., projections, bent substantially perpendicularly from the stacking surface 11*d* and protruding in the direction opposite to the direction in which the sheets are stacked on the stacking surface 11*d*.

Notches 11*a* and 11*a* are formed at both end portions in the width direction of the stacking surface 11*d*, and formed substantially in an H-shape.

U-shaped grooves 11*c* and 11*c* are respectively formed on the projecting surfaces 11*b* and 11*b*, and pivot shafts 13*f* and 13*f*, i.e., supporting portion, formed on a rising surface (not shown) rising from the bottom panel 13*a* of the case 13 engage to the U-shaped grooves 11*c* and 11*c*. The pivot shafts 13*f* and 13*f* are engaged to the U-shaped grooves 11*c* and 11*c* and locked by pins 21 and 21 (refer to FIGS. 5A and 5B). That is, the U-shaped grooves 11*c* and 11*c* and the pivot shafts 13*f* and 13*f* constitute a pivot fulcrum 30 of the intermediate plate 11, and the intermediate plate 11 is supported pivotably on the case 13 around the pivot shafts 13*f* and 13*f* arranged upstream in the sheet feed direction.

Figure 5A:
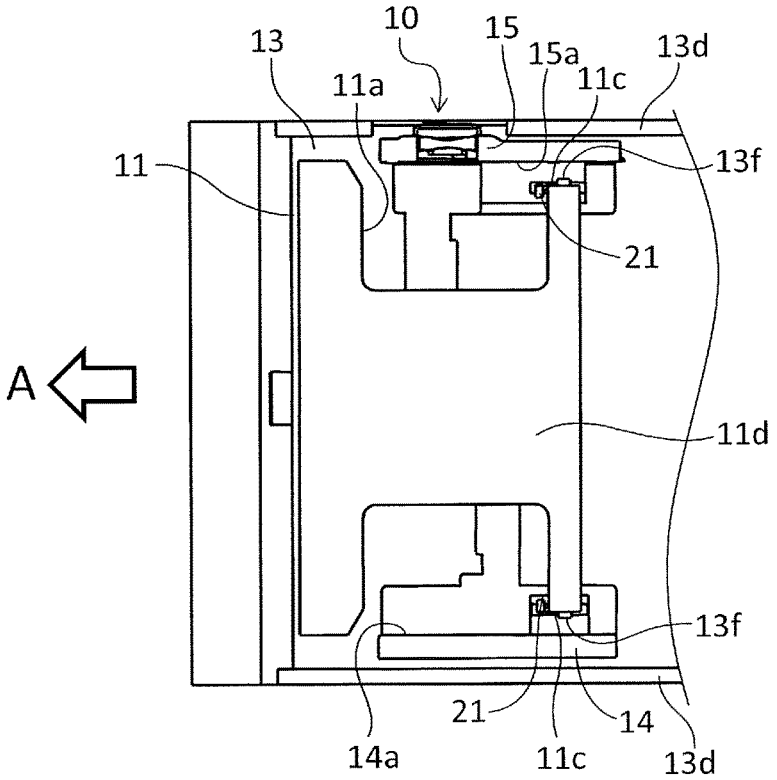
FIG. 5A is a plan view of a positional relationship between the intermediate plate and the width regulating member when the width regulating member is positioned at a first position.
Figure 5B:
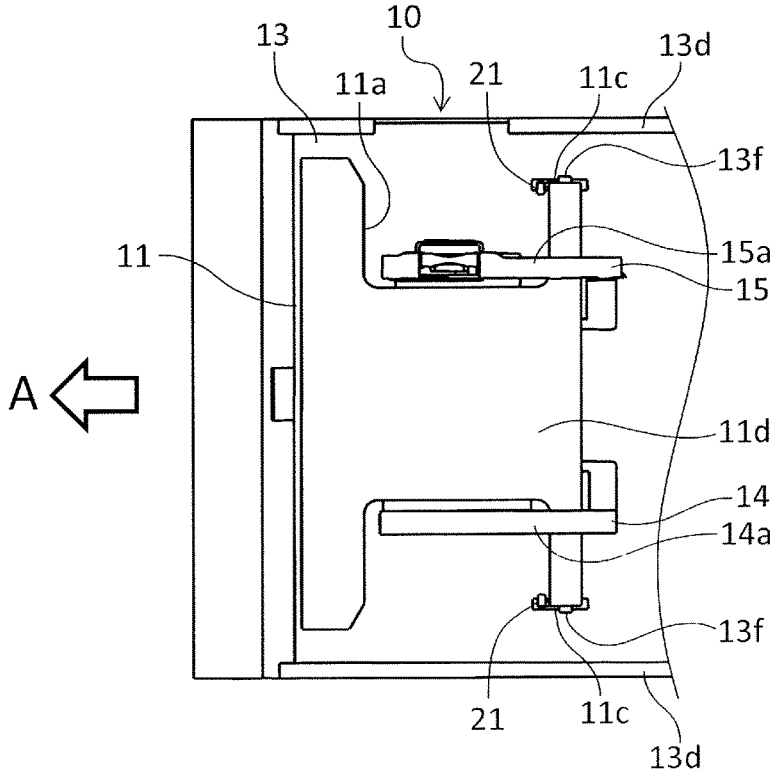
FIG. 5B is a plan view of the positional relationship between the intermediate plate and the width regulating member when the width regulating member is positioned at a second position.

The width regulating members 14 and 15 are supported movably on the case 13 between a first position illustrated in FIG. 5A and a second position illustrated in FIG. 5B positioned on an inner side in the width direction of the first position. In other words, the second position is a position closer to a center of the intermediate plate 11 in the width direction than the first position. In the present embodiment, the width direction position of a maximum-applicable sheet, such as a legal-sized sheet, is regulated by the width regulating members 14 and 15 at the first position, while the width direction position of a minimum-applicable sheet, such as an A6-sized sheet, is regulated by the width regulating members 14 and 15 at the second position.

As illustrated in FIG. 5A, the pivot shaft 13*f* and the U-shaped groove 11*c* are arranged on an inner side, i.e., closer to the center of the intermediate plate 11, in the width direction from the regulating surfaces 14*a* and 15*a* of the width regulating members 14 and 15 positioned at the first position. As illustrated in FIG. 5B, the pivot shaft 13*f* and the U-shaped groove 11*c* are arranged on an outer side in the width direction from the regulating surfaces 14*a* and 15*a* of the width regulating members 14 and 15 positioned at the second position. Further, the pivot shaft 13*f* and the U-shaped groove 11*c* are arranged at positions overlapped with the regulating surfaces 14*a* and 15*a* of the width regulating members 14 and 15 in the sheet feeding direction.

When moving the width regulating members 14 and 15 between the first position and the second position, the members are moved by gripping the lever portion 14*c*, as mentioned earlier. At that time, since the pivot shaft 13*f*, the U-shaped groove 11*c* and a portion of the intermediate plate 11 pass through the through-holes 14*f* and 15*f* respectively formed on the width regulating members 14 and 15, the pivot shaft 13*f* and the intermediate plate 11 do not interfere with the width regulating members 14 and 15. Further, the intermediate plate 11 pivots around the pivot shafts 13*f* and 13*f*, but the sizes of the through-holes 14*f* and 15*f* are set so that they do not interfere with the width regulating members 14 and 15 in all the pivot tracks.

Figure 8A:
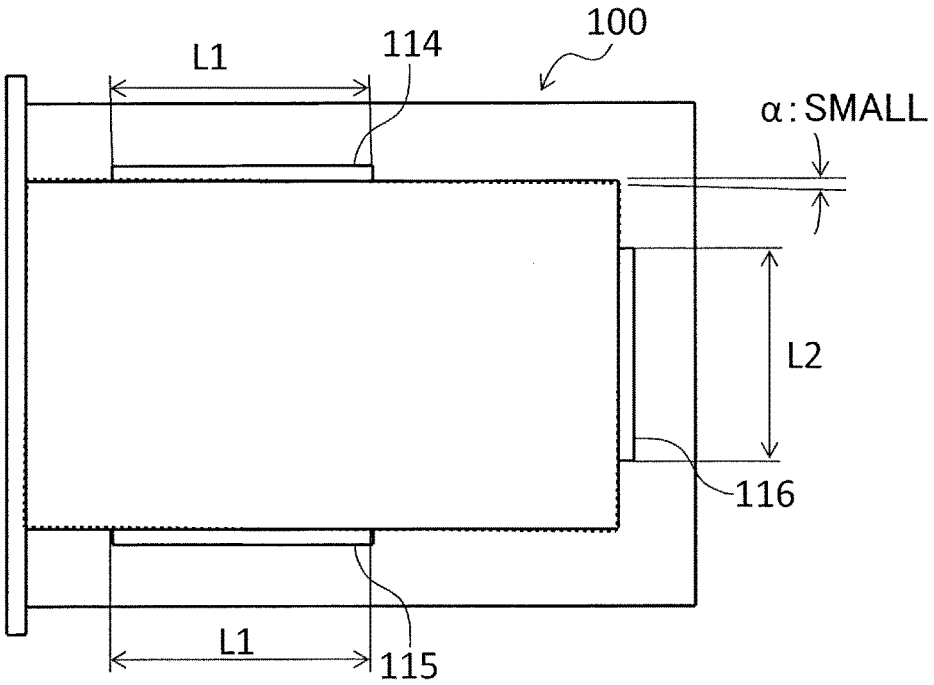
FIG. 8A is a plan view of a sheet feed cassette according to a first comparative example.
Figure 8B:
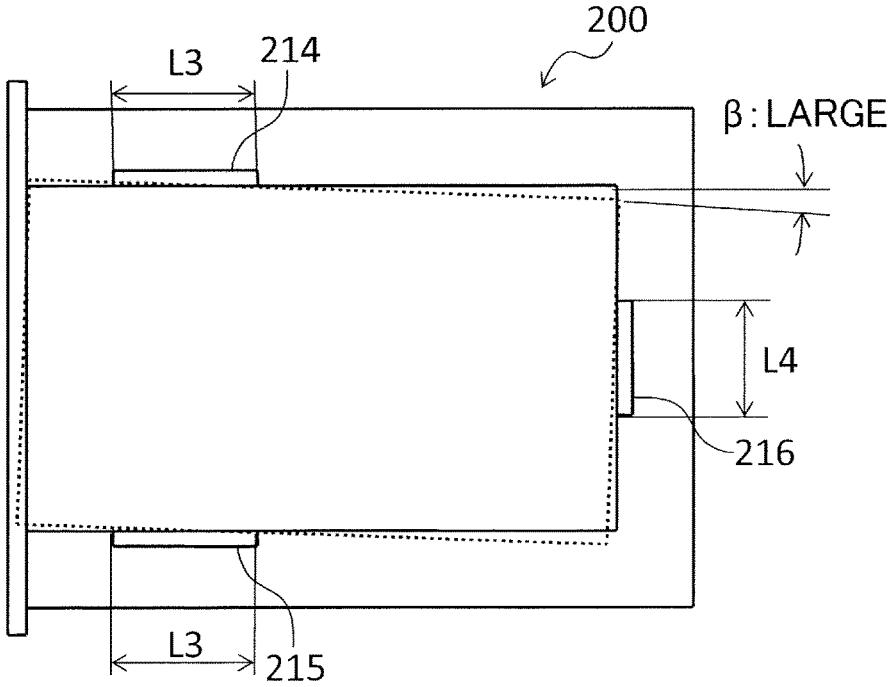
FIG. 8B is a plan view of a sheet feed cassette according to a second comparative example.
Figure 9A:
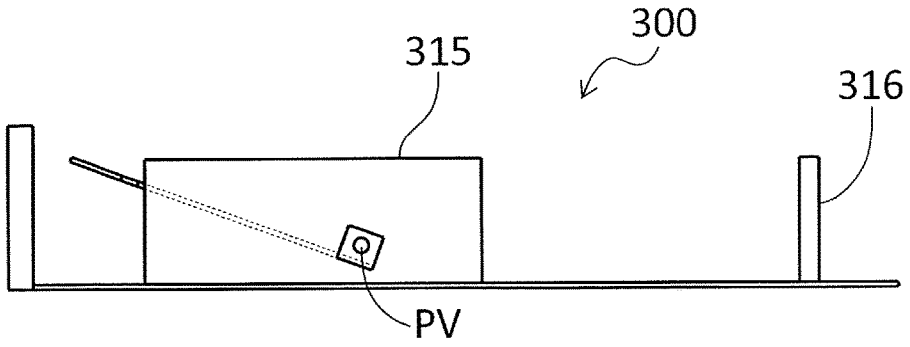
FIG. 9A is a side view of a sheet feed cassette according to a third comparative example.
Figure 9B:
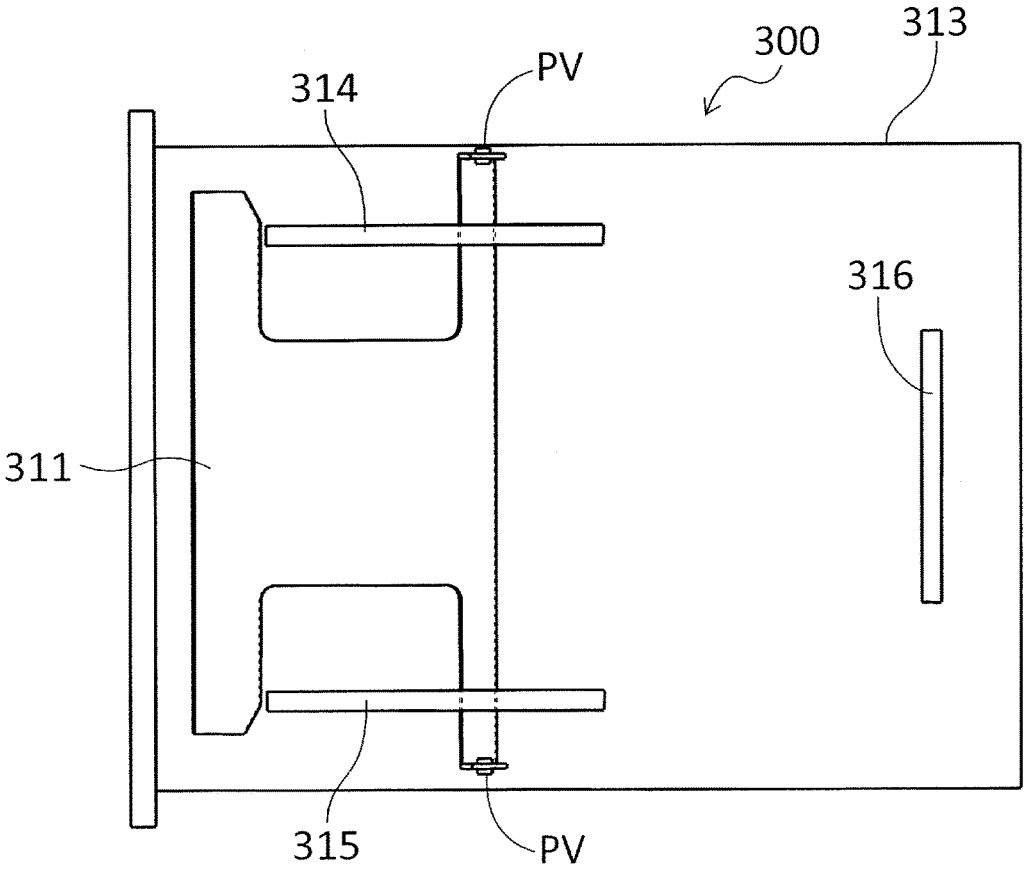
FIG. 9B is a plan view of the sheet feed cassette according to the third comparative example.

Now, a sheet feed cassette 100 according to a first comparative example is illustrated in FIG. 8A, and a sheet feed cassette 200 according to a second comparative example is illustrated in FIG. 8B. Further, a sheet feed cassette 300 according to a third comparative example is illustrated in FIGS. 9A and 9B. The lengths of width regulating members 114 and 115 of the sheet feed cassette 100 are set to length L1, and the length of a conveyance direction regulating member 116 is set to length L2. Length L3 of width regulating members 214 and 215 of the sheet feed cassette 200 is set smaller than length L1 (L3<L1), and length L4 of a conveyance direction regulating member 216 is set smaller than length L2 (L4<L2).

Incidentally, if the width regulating member or the conveyance direction regulating member are reduced in size to downsize the sheet feed cassette, the contact area between the end portion of the sheet and the width regulating portion member or the conveyance direction regulating member will be reduced. Therefore, especially when sending a large-sized sheet out from the sheet feed cassette, there is a tendency that the amount of skewing that occurs in the sheet is increased compared to the proper position shown by the solid line. For example, an amount of skewing $\beta$ of the sheet feed cassette 200 with a smaller width regulating member and conveyance direction regulating member will be greater than an amount of skewing $\alpha$ of the sheet feed cassette 100 ($\beta>\alpha$).

Further, as shown in FIGS. 9A and 9B, the sheet feed cassette 300 according to a third comparative example is configured to include a sheet stacking member 311 having a shorter length in the conveyance direction, so that a smaller sheet than the conventional sheet size can be used without reducing the size of width regulating members 314 and 315 or a conveyance direction regulating member 316. Therefore, pivot shafts PV of the sheet stacking member 311 are arranged to be overlapped with the width regulating members 314 and 315 in the sheet conveyance direction.

Since the pivot shafts PV of the sheet stacking member 311 are arranged between the width regulating members 314 and 315 and side walls 313 of the sheet feed cassette 300, the sheet feed cassette 300 must be extended toward an outer side in the width direction corresponding to the pivot shafts PV from the width regulating members 314 and 315. Such a configuration was a hindrance to realizing downsizing of the sheet feed cassette.

According to the present embodiment having the above-described configuration, the spaces between the width regulating members 14 and 15 arranged at the first position and side walls 13*d* and 13*d* rising up from the end portion in the width direction of the bottom panel 13*a* of the case 13 can be reduced compared to the first, second and third comparative examples, and therefore, the case 13 can be downsized in the width direction. This is made possible since the pivot shaft 13*f* and the U-shaped groove 11*c* are arranged on an inner side in the width direction from the regulating surfaces 14*a* and 15*a* of the width regulating members 14 and 15 positioned at the first position.

Further according to the present embodiment, the pivot shaft 13*f* and the U-shaped groove 11*c* are arranged at positions overlapped with the regulating surfaces 14*a* and 15*a* of the width regulating members 14 and 15 in the sheet feeding direction, and through-holes 14*f* and 15*f* are formed to the width regulating members 14 and 15 so as not to interfere with the intermediate plate 11. Thereby, the case 13 can be downsized in the sheet feeding direction. Further, the width regulating members 14 and 15 can be formed relatively long in the sheet feeding direction while downsizing the case 13 in the width direction and the sheet feeding direction, so that the amount of skewing of the sheets can be reduced, and a good printing precision can be achieved.

Moreover, since notches 11*a* and 11*a* are formed on the stacking surface 11*d* of the intermediate plate 11, the through-holes 14*f* and 15*f* formed to prevent the intermediate plate 11 from interfering with the width regulating members 14 and 15 can be made relatively small, and sufficient strength can be given to the width regulating members 14 and 15. Further, since the projecting surface 11*b* of the intermediate plate 11 is formed to protrude in an opposite direction from the direction in which the sheets are stacked on the stacking surface 11*d*, the projecting surface

11*b* will not interfere with the sheets when the sheets are stacked on the stacking surface 11*d*, and the sheets can be stacked stably on the smooth stacking surface 11*d*.

Figure 6A:
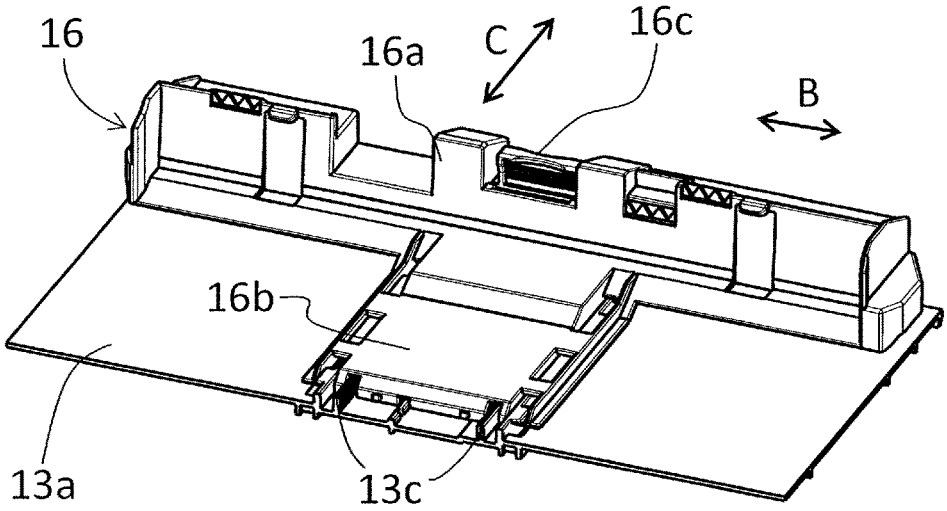
FIG. 6A is a perspective view of a rear end regulating member seen from above.
Figure 6B:
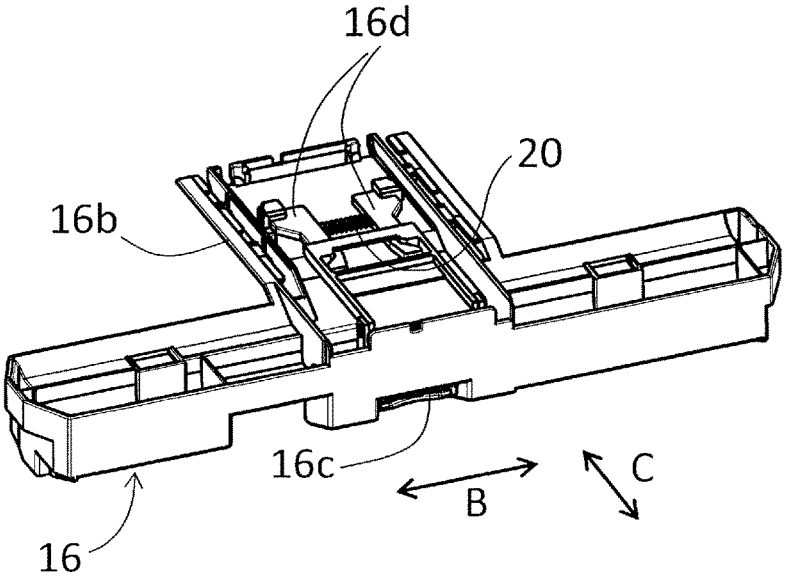
FIG. 6B is a perspective view of the rear end regulating member seen from below.

Next, we will describe the rear end regulating member 16, i.e., rear end regulating portion. As illustrated in FIGS. 6A and 6B, the rear end regulating member 16 includes a rear end regulating surface 16*a* regulating a rear end position in the sheet feeding direction of the sheets stacked on the intermediate plate 11, a connecting portion 16 extending in the sheet feeding direction, and a lever portion 16*c* positioning the rear end regulating member 16. The lever portion 16*c* has a lock portion 16*d* capable of being engaged with a rack portion 13*c* formed on the bottom panel 13*a* of the case 13, and the rack portion 13*c* and the lock portion 16*d* are engaged at the home position by the action of an elastic spring 20, and the rear end regulating member 16 is fixed to position. The engagement between the rack portion 13*c* and the lock portion 16*d* is released by operating the lever portion 16*c* of the rear end regulating member 16 against the biasing force of the elastic spring 20, so that the rear end regulating member 16 is enabled to be moved in the sheet feeding direction and a direction opposite to the sheet feeding direction (direction of arrow C).

Figure 7B:
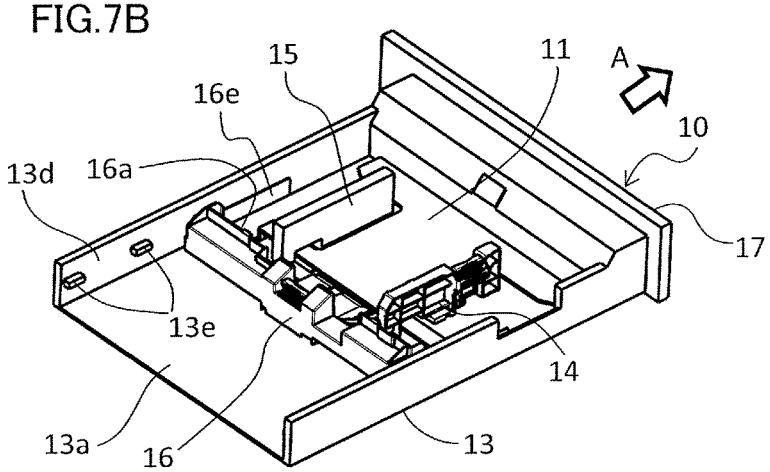
FIG. 7B is a perspective view of the rear end regulating member positioned at the second position.
Figure 7C:
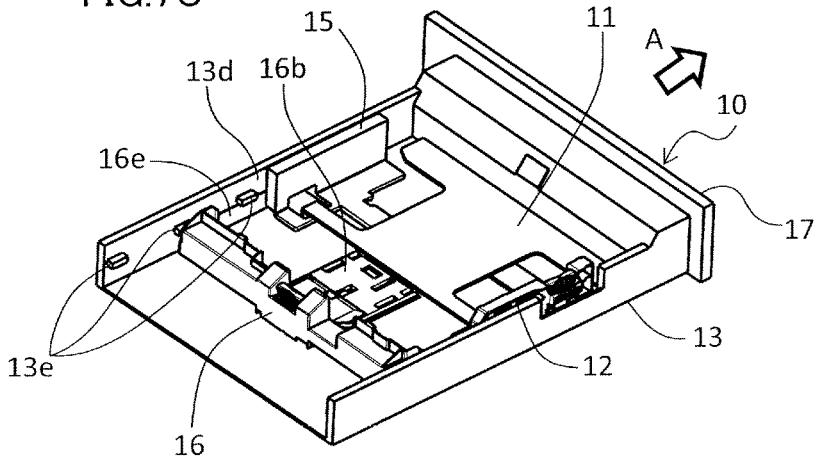
FIG. 7C is a perspective view of the rear end regulating member positioned between the first position and the second position.

As illustrated in FIGS. 7A through 7C, the rear end regulating member 16 has engaging portions 16*e* and 16*d* (refer to FIG. 6B) respectively engaging with a protrusion 13*e* formed on the side walls 13*d* and 13*d* of the case 13 and the bottom panel 13*a*.

FIG. 7A illustrates a position of the width regulating members 14 and 15 and the rear end regulating member 16 when regulating the end portion of a sheet having a maximum size applicable of the cassette 10 (which in the present embodiment is a legal size, for example). In other words, the rear end regulating member 16 is set at a position corresponding to the sheet having the width-direction position thereof regulated by the width regulating members 14 and 15 at the first position. At this time, the connecting portion 16*b* and the engaging portion 16*e* of the rear end regulating member 16 are engaged with the case 13 in a predetermined range, and arranged at a position not overlapped with the intermediate plate 11 in the sheet feeding direction.

FIG. 7B illustrates a position of the width regulating members 14 and 15 and the rear end regulating member 16 when regulating the end portion of a sheet having a minimum applicable size of the cassette 10 (which in the present embodiment is an A6 size, for example). In other words, the rear end regulating member 16 is set at a position corresponding to the sheet having the width-direction position thereof regulated by the width regulating members 14 and 15 positioned at the second position. At this time, the connecting portion 16*b* and the engaging portion 16*e* of the rear end regulating member 16 are engaged with the case 13, and arranged at a position overlapped with the intermediate plate 11 in the sheet feeding direction.

The connecting portion 16*b* of the rear end regulating member 16 is inserted to the space between the intermediate plate 11 and the bottom panel 13*a* of the case 13, and it will not interfere with the intermediate plate 11. Further, this space is formed by projecting the projecting surface 11*b* of the intermediate plate 11 to an opposite direction from the direction in which the sheet is stacked on the stacking surface 11*d*, and therefore, the rear end regulating member 16 can be arranged close to the intermediate plate 11 and the width regulating members 14 and 15. Thereby, the cassette 10 can correspond to various sheet sizes without increasing the size of the cassette 10.

Further, since the engaging portion 16*e* of the rear end regulating member 16 is arranged on an outer side in the width direction from the pivot shaft 13*f* and the U-shaped groove 11*c*, the engaging portion 16*e* will not interfere with the pivot shaft 13*f* and the U-shaped groove 11*c* even when the rear end regulating member 16 regulates the rear end of a small-sized sheet. Therefore, the engaging portion 16*e* can be formed long in the sheet feeding direction.

FIG. 7C illustrates a position of the width regulating members 14 and 15 and the rear end regulating member 16 when regulating the end portion of a sheet having an intermediate size between the minimum and maximum-applicable sizes in the cassette 10. This position can, but does not have to, be applied to a regular-sized sheet. As illustrated in FIG. 7C, there is a case where the width regulating members 14 and 15 are positioned at the first position and the rear end regulating member 16 is positioned downstream in the sheet feeding direction. At this time, the width regulating members 14 and 15 and the side walls 13*d* and 13*d* of the case 13 are arranged close by, and it is also possible to have notches formed on the width regulating members 14 and 15 so that the engaging portions 16*e* and 16*d* of the rear end regulating member 16 do not interfere with the width regulating members 14 and 15.

This configuration of the rear end regulating member 16 described above enables the rear end regulating member 16 to be engaged with the case 13 by the connecting portion 16*b* and the engaging portions 16*e* and 16*d*, so that the position of the rear end regulating member 16 can be stabilized, the amount of skewing of the sheets can be reduced, and a preferable printing precision can be achieved. Since the engaging portion 16*e* does not interfere with the pivot shaft 13*f* and the U-shaped groove 11*c*, the engaging portion 16*e* can be formed long in the sheet feeding direction, and so the positioning of the rear end regulating member 16 can be realized with greater stability.

According to the present embodiment, the lengths in the sheet feeding direction of the connecting portion 16*b* and the engaging portion 16*e* are set approximately the same, but the lengths can be set differently.

Further, the U-shaped groove 11*c* is formed to the projecting surface 11*b* of the intermediate plate 11, but the shape of the U-shaped groove 11*c* can be designed freely, and it can be a round hole, for example. This configuration enables to omit the pin 21 locking the pivot shafts 13*f* and 13*f*.

According to the present embodiment, the pivot shaft 13*f* is formed on the case 13, and the U-shaped groove 11*c* is formed on the intermediate plate 11, but it is also possible to have the U-shaped groove formed on the case 13 and the pivot shaft formed on the intermediate plate 11. The present invention can be applied not only to cassettes storing sheets, but also to manual sheet-feeding trays.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-043474, filed Mar. 5, 2015, which is hereby incorporated by reference herein in its entirety.

What is claimed is:

1. A sheet stacking apparatus comprising:

a body;

a stacking portion on which a sheet is stacked;

a regulating portion configured to move between a first position and a second position closer to a center of the stacking portion in a width direction orthogonal to a sheet feeding direction than the first position, the regulating portion comprising a regulating surface configured to regulate a position, in the width direction, of the sheet stacked on the stacking portion, and a plurality of hook portions configured to engage with the body; and a supporting portion pivotably supporting the stacking portion, the supporting portion disposed on the body and closer to the center of the stacking portion in the width direction than the regulating surface of the regulating portion positioned at the first position, wherein the regulating portion defines a through portion through which the supporting portion passes in a case where the regulating portion moves between the first position and the second position, the regulating surface is positioned closer to the center of the stacking portion than the supporting portion in a case where the regulating portion is at the second position, and the plurality of hook portions comprises a first hook portion disposed more upstream than the through portion in the sheet feeding direction, and a second hook portion disposed more downstream than the through portion in the sheet feeding direction.

2. The sheet stacking apparatus according to claim 1, wherein the stacking portion comprises a stacking surface on which a sheet is stacked, and a projection protruding from a surface opposite to the stacking surface, and the supporting portion pivotably supports the projection.

3. The sheet stacking apparatus according to claim 1, wherein the body comprises a bottom panel, a side wall rising up from an end portion in the width direction of the bottom panel, and the supporting portion disposed on the bottom panel, and stores the sheet stacked on the stacking portion, the first hook portion configured to engage with a first portion, of the bottom panel, defining a first hole into which the first hook portion is inserted, and the second hook portion configured to engage with a second portion, of the bottom panel, defining a second hole into which the second hook portion is inserted.

4. The sheet stacking apparatus according to claim 3, further comprising a rear end regulating portion comprising a connecting portion connected to the bottom panel movably in the sheet feeding direction and in a direction opposite to the sheet feeding direction, and regulating a rear end position of the sheet stacked on the stacking portion, wherein the connecting portion is configured to be movable to a position overlapped with the stacking portion in the sheet feeding direction.

5. The sheet stacking apparatus according to claim 4, wherein the rear end regulating portion comprises an engaging portion protruding in the sheet feeding direction from an end portion, in the width direction, of the rear end regulating portion, and engaging with the side wall, and the engaging portion is disposed farther to the center of the sheet stacking portion in the width direction than the supporting portion.

6. The sheet stacking apparatus according to claim 5, wherein the engaging portion is configured to be movable to a position overlapping with the stacking portion and the regulating portion in the sheet feeding direction.

7. An image forming apparatus comprising:

the sheet stacking apparatus according to claim 1; and an image forming portion forming an image on a sheet fed from the sheet stacking apparatus.

8. The sheet stacking apparatus according to claim 3, wherein the first hook portion comprises a first protruding part extending downward and penetrating the first hole, and a first stopper extending downstream in the sheet feeding direction from a lower end of the first protruding part, and the second hook portion comprises a second protruding part extending downward and penetrating the second hole, and a second stopper extending upstream in the sheet feeding direction from a lower end of the second protruding part.

9. A sheet stacking apparatus comprising:

a body;

a stacking portion on which a sheet is stacked;

a regulating portion configured to move between a first position and a second position closer to a center of the stacking portion in a width direction orthogonal to a sheet feeding direction than the first position, and comprising a regulating surface configured to regulate a position, in the width direction, of the sheet stacked on the stacking portion; and a supporting portion configured to pivotably support the stacking portion and provided on the body, the supporting portion being disposed at a position overlapping with the regulating surface of the regulating portion in the sheet feeding direction, an entirety of the supporting portion being disposed closer to the center of the stacking portion in the width direction than the regulating surface of the regulating portion at the first position and disposed further from the center of the stacking portion in the width direction than the regulating surface of the regulating portion at the second position, wherein the regulating portion defines a through portion through which the supporting portion passes in a case where the regulating portion moves between the first position and the second position.

10. The sheet stacking apparatus according to claim 9, wherein the supporting portion is provided on one side where the regulating portion is provided.

11. The sheet stacking apparatus according to claim 9, wherein the regulating portion comprises a first hook portion disposed more upstream than the through portion in the sheet feeding direction, and a second hook portion disposed more downstream than the through portion in the sheet feeding direction.

* * * * *